US007004003B2

(12) United States Patent
Del Fabro et al.

(10) Patent No.: US 7,004,003 B2
(45) Date of Patent: Feb. 28, 2006

(54) BENDING MACHINE FOR PROFILES

(75) Inventors: Giorgio Del Fabro, Tricesimo (IT); Marcello Del Fabro, Tavagnacco (IT)

(73) Assignee: M.E.P. Macchine Elettroniche Piegatrici SpA, Reana Del Rojale (IT)

( * ) Notice: Subject to any disclaimer, the term of this patent is extended or adjusted under 35 U.S.C. 154(b) by 21 days.

(21) Appl. No.: 10/489,300

(22) PCT Filed: Sep. 10, 2002

(86) PCT No.: PCT/IB02/03640

§ 371 (c)(1),
(2), (4) Date: Mar. 11, 2004

(87) PCT Pub. No.: WO03/024640

PCT Pub. Date: Mar. 27, 2003

(65) Prior Publication Data

US 2004/0250591 A1 Dec. 16, 2004

(30) Foreign Application Priority Data

Sep. 14, 2001 (IT) ..... UD2001A0146
Oct. 31, 2001 (IT) ..... UD2001A0174

(51) Int. Cl.
*B21D 5/04* (2006.01)
*B21D 11/12* (2006.01)

(52) U.S. Cl. ..... 72/294; 72/307

(58) Field of Classification Search ..... 72/294, 72/307, 339, 332, 337, 129, 405.06

See application file for complete search history.

(56) References Cited

U.S. PATENT DOCUMENTS

| | | | | |
|---|---|---|---|---|
| 1,771,955 | A * | 7/1930 | Fork et al. | 72/129 |
| 2,153,524 | A * | 4/1939 | Schmidt | 72/129 |
| 3,626,994 | A * | 12/1971 | Klenz | 140/82 |
| 4,621,511 | A * | 11/1986 | Knudson | 72/186 |
| 5,009,097 | A | 4/1991 | Del Fabro et al. | |
| 6,227,026 | B1 * | 5/2001 | Mizukawa | 72/294 |

FOREIGN PATENT DOCUMENTS

| | | |
|---|---|---|
| DE | 1752716 | 7/1971 |
| EP | 0374465 | 6/1990 |
| EP | 0537496 | 4/1993 |
| EP | 0882529 | 12/1998 |
| FR | 2553314 | 4/1985 |
| FR | 2704784 | 11/1994 |

* cited by examiner

*Primary Examiner*—Daniel C. Crane
(74) *Attorney, Agent, or Firm*—Stevens, Davis, Miller & Mosher, LLP

(57) ABSTRACT

Bending machine for profiles comprising at least a drawing assembly able to draw the profiles, a first shearing device arranged downstream of the drawing assembly and bending means arranged downstream of the first shearing means. A second shearing device is arranged upstream of at least part of the drawing assembly and is able to shear the profiles to eliminate excess parts thereof.

18 Claims, 4 Drawing Sheets

BENDING MACHINE FOR PROFILES

This application is a §371 National Stage Application of International Application No. PCT/IB02103 640, filed on 10 Sep. 2002, claiming the priority of Italian Patent Application No. UD2001A000146 filed on 14 Sep. 2001 and Italian Patent Application No. UD2001A000174 filed on 31 Oct. 2001.

FIELD OF THE INVENTION

The invention concerns a bending machine for profiles, such as for example round pieces used for reinforcement purposes or similar, comprising at least a drawing assembly, first shearing means arranged downstream of the drawing assembly, second shearing means arranged upstream of at least part of the drawing assembly and bending means.

To be more exact, the invention is applied for bending and shaping straight bars already sheared to size, and able to form stirrups or other shaped elements for reinforcement purposes. The invention, selectively using the second shearing means located upstream of at least part of the drawing assembly, allows to eliminate possible working off-cuts and to discharge them in a position not dangerous for the machine operator and for the other operating assemblies of the machine.

BACKGROUND OF THE INVENTION

The state of the art includes bending machines for profiles, such as round pieces used for reinforcement purposes or similar, single or in bundles, wherein the shearing means, usually consisting of a shears arranged downstream of the drawing assembly and upstream of the bending means, are able to shear said profiles.

When they are working bars pre-sheared to size, such bending machines have problems with regard to the discharge of possible working off-cuts, deriving from the difference between the length of the bar and the linear development of the stirrup formed.

To be more exact, once the profile has been shaped so as to form a reinforcement stirrup, a terminal segment of the bar may be in excess with respect to the stirrup obtained, and may remain at least partly gripped on the drawing assembly after shearing has been accomplished.

This sheared segment, or off-cut, then has to be discharged from the machine and in particular from the drawing means in order to start a new production cycle.

To discharge the off-cut, one conventional solution provides to include, downstream of the drawing assembly, at least a pair of ejector rollers; these rollers are able to intervene after shearing, so that the off-cut is expelled from the machine, thus freeing the drawing assembly.

With this solution however, there is the risk that the discharged off-cut might interfere with the bending means, arranged immediately downstream of the shears, or with other operating assemblies which can be present on the bending machine, compromising the correct functioning thereof. Moreover, this conventional solution does not guarantee sufficient safety for the machine operator, since the off-cuts thus discharged can hit him.

The present Applicant has devised and embodied this invention to overcome this shortcoming of the state of the art, and to obtain further advantages.

SUMMARY OF THE INVENTION

The invention is set forth and characterized essentially in the main claim, while the dependent claims describe other innovative characteristics of the invention.

The purpose of the invention is to achieve a bending machine for profiles, such as for example round pieces for reinforcement purposes or similar, wherein any possible working off-cuts are discharged in a position sufficiently distant from the operating assemblies of this machine, such as for example the bending means or suchlike, so that these off-cuts once discharged do not interfere with the correct functioning of the machine.

Another purpose of the invention is to reduce to a minimum the risk that these off-cuts might hit the machine operator when they are discharged.

The bending machine for profiles where the present invention is applied comprises a drawing assembly able to draw these profiles, first shearing means arranged downstream of the drawing assembly and bending means arranged downstream of these first shearing means.

According to a characterizing feature of the invention, second shearing means, such as for example a shears, are arranged upstream of at least part of the drawing assembly and are able to shear the profiles to size, before the bending cycle is started, so as to eliminate the off-cuts in advance, when there is a known difference between the length of the pre-sheared bar and the linear development of the stirrups to be formed.

In a first embodiment of the invention, wherein the drawing assembly comprises at least a pair of fixed rollers, the second shearing means are arranged upstream of said pair of fixed rollers, In a first solution, the second shearing means are located distant from said pair of fixed rollers, for example in correspondence or in proximity with a bar-loading position. According to a variant, the second shearing means are located directly next to said pair of fixed rollers.

According to another embodiment of the invention, wherein the drawing assembly comprises at least a pair of fixed rollers and a gripper movable between a first bar-loading position and a second-drawing position cooperating with said pair of fixed rollers, the second shearing means are arranged either in an intermediate position between the fixed rollers and the movable gripper, or upstream of said movable gripper's bar-loading position.

In a further form of embodiment, wherein the drawing assembly comprises at least a pair of rollers movable between said loading and drawing positions, the second shearing means are assembled either next to said pair of movable rollers and move therewith, or distant therefrom in correspondence or proximity with said bar-loading position.

According to another embodiment, the drawing assembly comprises two groups of pairs of fixed rollers, a first group arranged in cooperation and upstream of the bending assembly, and a second group arranged upstream in correspondence or proximity with the bar-loading position. In this case, the second shearing means are arranged in an intermediate position between said two groups of pairs of fixed rollers.

According to a variant, said second shearing means are arranged upstream of the second group of pairs of rollers.

The off-cuts thus sheared by the second shearing means, according to a variant, are discharged inside collection means, thus facilitating their elimination.

According to a variant, these collection means comprise a container arranged upstream and below these second shearing means, so that the off-cuts fall inside through the effects of gravity and can thus be easily eliminated.

With the machine according to the invention it is possible to shear the off-cuts upstream of at least part of the drawing assembly and the bending means, thus eliminating the problem of possible interference with the latter. Moreover, the off-cuts are discharged without the intervention of ejector rollers positioned for this purpose in proximity with the bending means; this means that such rollers do not need to be installed, and prevents the off-cuts from being dangerous for the machine operator.

BRIEF DESCRIPTION OF THE DRAWINGS

These and other characteristics of the invention will become apparent from the following description of some preferential forms of embodiment, given as a non-restrictive example, with reference to the attached drawings wherein.

DETAILED DESCRIPTION OF SOME PREFERENTIAL EMBODIMENTS

Figure 1:
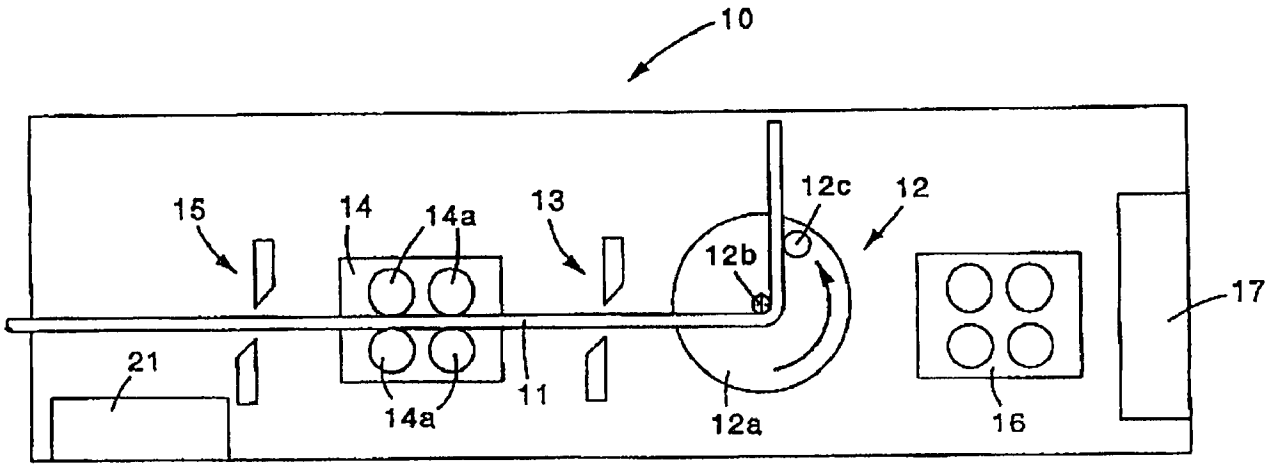
FIG. 1 shows schematically, with a view from above, a bending machine for profiles according to the invention in a first form of embodiment.

With reference to the attached Figures, a bending machine 10 for profiles 11 according to the invention comprises bending means 12 able to bend/shape the profile 11, first shearing means 13 arranged upstream of the bending means 12, and able to finish the bent profiles by eliminating the excess parts thereof, a drawing assembly 14 arranged upstream of the first shearing means 13, and able to make the profile 11 advance towards the bending means 12, and second shearing means 15, arranged upstream of at least part of the drawing assembly 14 and able to shear to size the profile 11 before the bending and shaping steps thereof.

The bending machine 10 is suitable to operate on straight bars, pre-sheared to size, with a length of for example 12 m, supplied from a store and/or fed by an automatic or manual feeder included for this purpose.

The machine 10 also comprises, downstream of the bending means 12, a second drawing assembly 16 to perform tail-end bends, and a retaining element 17 able to prevent the bent segments of the profile 11 from rising up with respect to an ideal plane.

The bending means 12 substantially comprise a central plate 12*a* assembled rotatable around a contrasting pin 12*b*. On the upper surface and in a substantially peripheral zone of the central plate 12*a*, a bending pin 12*c* is mounted, by means of which it is possible to accomplish, as shown, the bending of the profile 11.

The first shearing means 13 substantially comprise a shears and are able to finish the profiles 11 after they have been bent, that is, in the case of reinforcement stirrups, at the end of the bending/shaping process the excess is sheared from the trailing end, normally a few millimeters long, which protrudes from the geometry of the stirrup.

The machine 10 also comprises, as we have said, second shearing means 15, arranged upstream of at least part of the drawing assembly 14 and, in this case, also consisting of a shears. These second shearing means 15 are able to crop the pre-sheared profile 11 to a pre-set size according to the reinforcement element to be made.

For example, if it is desired to make stirrups for reinforcement cages using pre-sheared bars 11 with a length of 12 m, the linear development of said stirrups is about 11.20 m. Using these second shearing means 15, it is possible to shear off the last 800 mm in advance, and then proceed with the subsequent steps of feeding, bending and shaping.

The off-cut formed by this cropping operation is discharged, in the case shown here, into collection means 21, either by gravity, if these collection means are arranged upstream and below the shears 15, or by means of a suitable gripper member which picks up the sheared off-cut and deposits it into appropriate containers.

In this way, the discharged off-cut does not interfere with the bending means 12 or with drawing assembly 14 and does not need to use mechanical members to force the discharge thereof.

Moreover, the discharge does not entail any danger for the safety of the worker.

The drawing assembly 14, in the case shown in FIG. 1, is of the fixed type formed by two pairs of rollers 14*a* arranged so as to ensure a grip on the profile 11 in order to feed it to the bending means 12. In this case, the shears 15 is arranged upstream of the entire drawing assembly 14.

Figure 2:
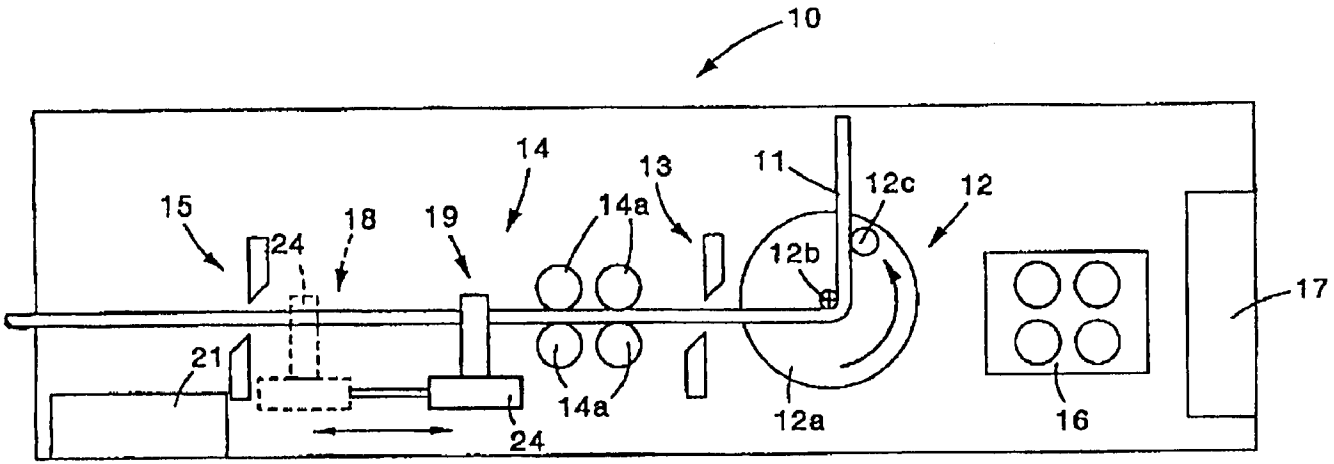
FIG. 2 shows a second form of embodiment of FIG. 1.
Figure 6:
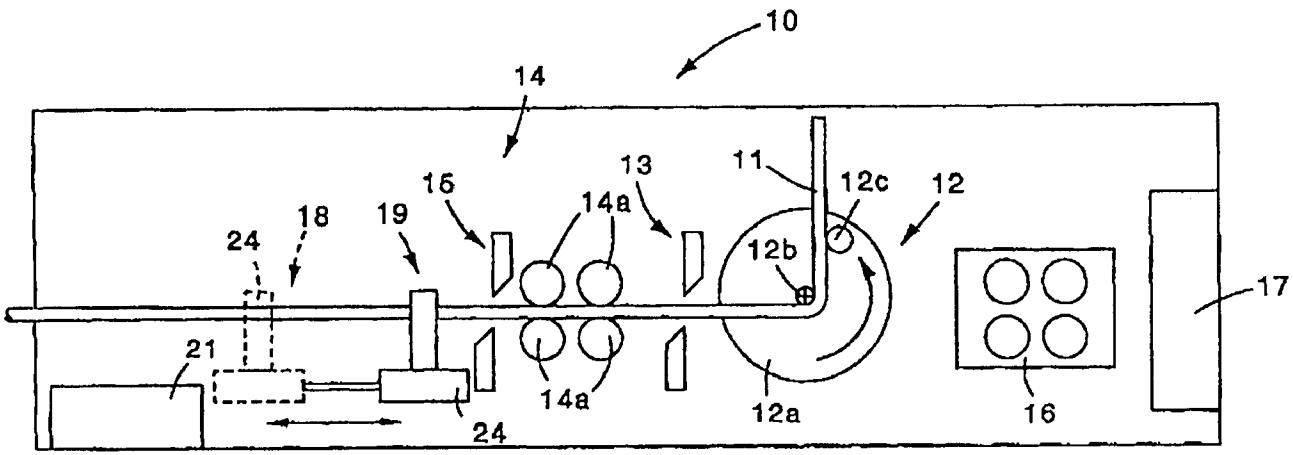
FIG. 6 shows a variant of FIG. 2.

In the embodiment shown in FIGS. 2 and 6, the drawing assembly 14 consists of two pairs of fixed rollers 14*a*, able to grip on the profile 11, and a gripper 24 movable between a first loading position 18 (shown by a line of dashes), wherein it is distant from said rollers 14*a*, to pick up the profiles 11, and a drawing position 19 (shown by a continuous line in FIG. 2), wherein it is in proximity with the rollers 14*a*, to which it delivers the profile 11 so that it can be fed towards the bending means 12. In the first solution shown in FIG. 2, the shears 15 is located far from the rollers 14*a* and upstream of the loading position 18 of the movable gripper 24; in the variant shown in FIG. 6, the shears 15 is located in an intermediate position between the rollers 14*a* and the drawing position 19 of the movable gripper 24.

Figure 3:
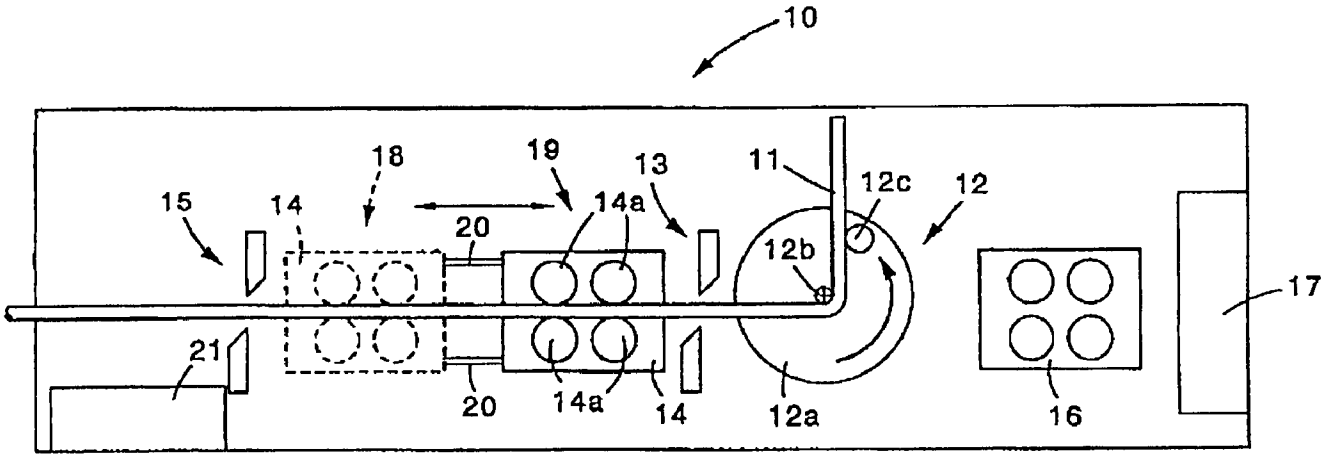
FIG. 3 shows a third form of embodiment of FIG. 1.
Figure 5:
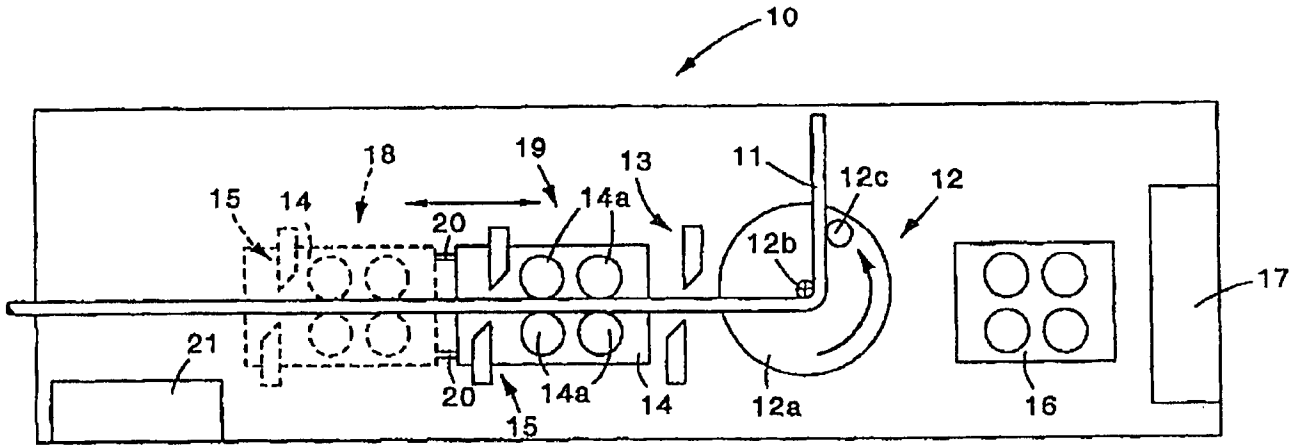
FIG. 5 shows a variant of FIG. 3.

In the embodiments shown in FIGS. 3 and 5, the drawing assembly 14 with the pairs of rollers 14*a* is of the movable type, that is, the pairs of rollers 14*a* are mounted on guides or rails 20 which allow them to be moved between a first loading position 18 (shown by a line of dashes) wherein it is distant from the bending means 12 and the first shearing means 13, to pick up a profile 11, and a second drawing position 19 (shown by a continuous line), wherein it is in proximity with the first shearing means 13 and is able to feed the bending means 12. In the embodiment shown in FIG. 3, the shears 15 is located upstream of the loading position 18 of the drawing assembly 14, while in the variant shown in FIG. 5 the shears 15 is located upstream and on board said drawing assembly 14 and moves therewith between the loading position 18 and the drawing position 19.

Figure 4:
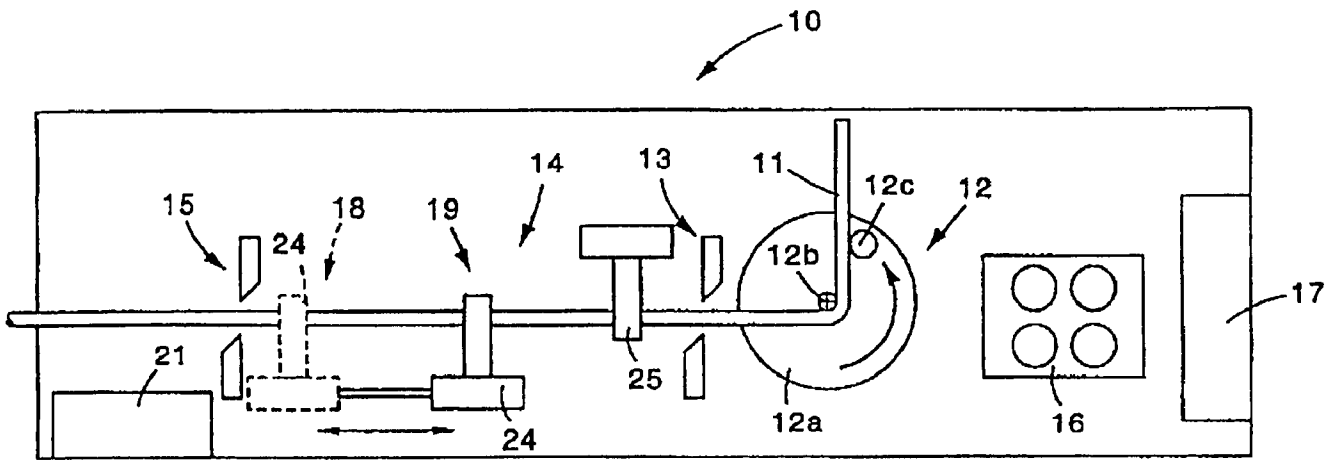
FIG. 4 shows a fourth form of embodiment of FIG. 1.

In the further embodiment shown in FIG. 4, the drawing assembly 14 comprises a first gripper 24 movable between a loading position 18 (shown by a line of dashes) wherein it is distant from the bending means 12, and a drawing position 19 (shown by a continuous line), wherein it is in proximity with a second gripper 25. This second gripper 25 is fixed and is able to retain the profile 11 every time the gripper 24 passes from the drawing position 19 to the loading position 18. In this embodiment, the shears 15 is arranged upstream of the gripper 24 in cooperation with said loading position 18. It comes within the field of the invention that the shears

15 be located in an intermediate position between the drawing position 19 of the movable gripper 24 and the fixed gripper 25.

Figure 7:
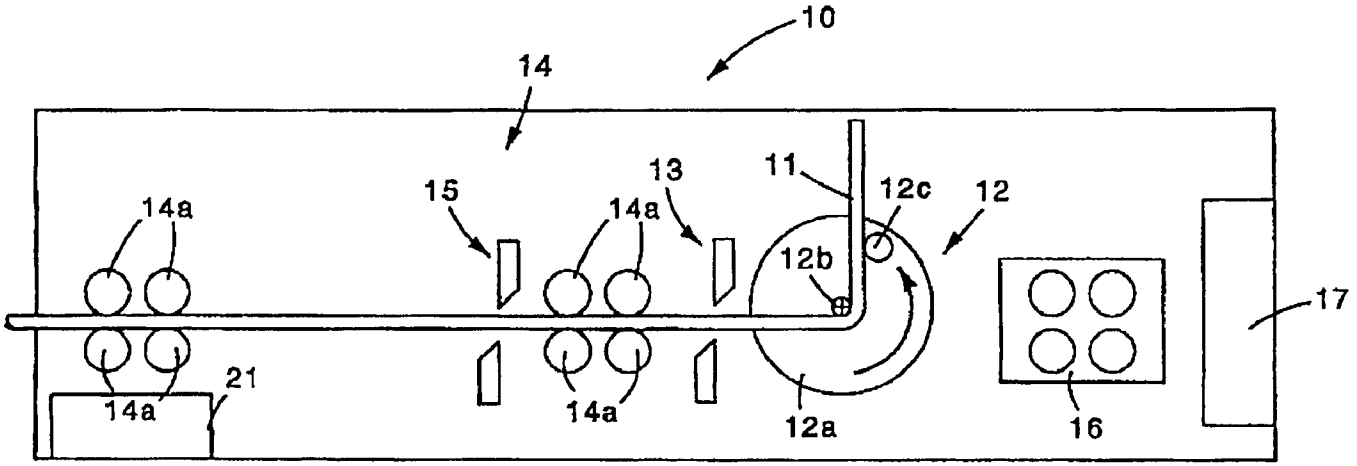
FIG. 7 shows a further form of embodiment of FIG. 1.
Figure 8:
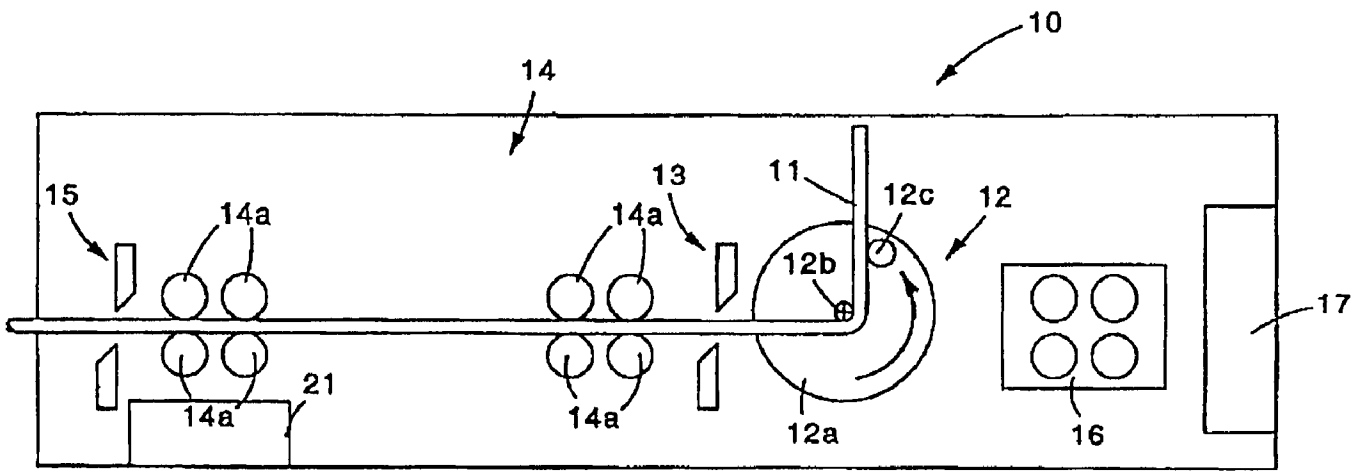
FIG. 8 shows a variant of FIG. 7.

In the other embodiment shown in FIG. 7, the drawing assembly 14 comprises in its entirety two groups of pairs of fixed rollers 14*a,* one in proximity with the bending means 12 and the other upstream and distant from the first. In this case, the shears 15 is located in an intermediate position between said two pairs of fixed rollers. According to a variant of this last embodiment, the shears 15 (FIG. 8) is provided upstream of the second group of fixed rollers 14*a*.

It is obvious that modifications or additions may be made to the bending machine 10 as described heretofore, without departing from the spirit and scope of the invention.

For example, according to a variant, as we have said, the drawing assembly 14 may consist of only movable grippers able to make the profile 11 advance step-wise, or of combinations of grippers and rollers of a different type from those shown.

It is also obvious that, although the invention has been described with reference to specific examples, a skilled person shall certainly be able to achieve many other equivalent embodiments of bending machine for profiles, all of which shall come within the field and scope of this invention.

What is claimed is:

1. Bending machine for profiles comprising at least a drawing assembly able to draw said profiles, first shearing means arranged downstream of said drawing assembly, bending means arranged downstream of said first shearing means, and second shearing means arranged upstream of at least part of said drawing assembly and able to shear said profiles to eliminate excess parts thereof, wherein at least part of said drawing assembly is movable between a loading position wherein said at least part of said drawing assembly is distant from said bending means, and a drawing position wherein said at least part of said drawing assembly is in proximity with said first shearing means to feed said profile to said bending means, wherein said second shearing means is arranged upstream of said loading position.

2. Machine as in claim 1, wherein said second shearing means comprises a shears.

3. Machine as in claim 1, wherein said drawing assembly comprises fixed rollers, wherein said second shearing means is arranged upstream of said fixed rollers.

4. Machine as in claim 1, wherein said drawing assembly comprises a first group of fixed rollers arranged in cooperation with a loading position distant from said bending means and a second group of fixed rollers arranged in cooperation with a drawing position near said bending means, wherein said second shearing means is arranged in an intermediate position between said first and second group of fixed rollers.

5. Machine as in claim 1, wherein said drawing assembly comprises a first group of fixed rollers arranged in cooperation with a loading position distant from said bending means and a second group of fixed rollers arranged in cooperation with a drawing position near said bending means, wherein said second shearing means is arranged upstream of said second group of fixed rollers.

6. Machine as in claim 1, wherein collection means is able to cooperate with said second shearing means to collect said excess parts of said profiles after shearing.

7. Machine as in claim 6, wherein said collection means comprises a container arranged upstream of and below said second shearing means, into which said excess parts are able to be discharged through gravity.

8. Machine as in claim 1, wherein said movable part of the drawing assembly comprises at least a pair of rollers movable between said loading position and said drawing position.

9. Machine as in claim 1, wherein said movable part of the drawing assembly comprises a gripper element movable between said loading position and said drawing position.

10. Machine as in claim 8, wherein said second shearing means is arranged upstream and next to said pair of movable rollers, so as to move between said loading position and said drawing position together with said movable rollers.

11. Machine as in claim 9, wherein said drawing assembly comprises at least a fixed gripper cooperating with said movable part.

12. Bending machine for profiles comprising at least a drawing assembly able to draw said profiles, first shearing means arranged downstream of said drawing assembly, bending means arranged downstream of said first shearing means, and second shearing means arranged upstream of at least part of said drawing assembly and able to shear said profiles to eliminate excess parts thereof, wherein at least part of said drawing assembly is movable between a loading position wherein said at least part of said drawing assembly is distant from said bending means, and a drawing position wherein said at least part of said drawing assembly is in proximity with said first shearing means to feed said profile to said bending means, wherein said second shearing means is arranged in an intermediate position between the movable part and the fixed part of said drawing assembly.

13. Machine as in claim 12, wherein said movable part of the drawing assembly comprises at least a pair of rollers movable between said loading position and said drawing position.

14. Machine as in claim 12, wherein said movable part of the drawing assembly comprises a gripper element movable between said loading position and said drawing position.

15. Machine as in claim 13, wherein said second shearing means is arranged upstream and next to said pair of movable rollers, so as to move between said loading position and said drawing position together with said movable rollers.

16. Machine as in claim 14, wherein said drawing assembly comprises at least a fixed gripper cooperating with said movable part.

17. Machine as in claim 12, wherein collection means is able to cooperate with said second shearing means to collect said excess parts of said profiles after shearing.

18. Machine as in claim 17, wherein said collection means comprises a container arranged upstream of and below said second shearing means, into which said excess parts are able to be discharged through gravity.

* * * * *